US010434341B1

(12) United States Patent
Torbenson et al.

(10) Patent No.: US 10,434,341 B1
(45) Date of Patent: Oct. 8, 2019

(54) MASK APPARATUSES AND APPROACH

(71) Applicants: Steve Gordon Torbenson, Lakeville, MN (US); Jordan Daniel Torbenson, Lakeville, MN (US)

(72) Inventors: Steve Gordon Torbenson, Lakeville, MN (US); Jordan Daniel Torbenson, Lakeville, MN (US)

( * ) Notice: Subject to any disclaimer, the term of this patent is extended or adjusted under 35 U.S.C. 154(b) by 1160 days.

(21) Appl. No.: 14/732,275

(22) Filed: Jun. 5, 2015

(51) Int. Cl.

| | |
|---|---|
| ***A62B 23/02*** | (2006.01) |
| ***A62B 18/08*** | (2006.01) |
| ***A62B 18/02*** | (2006.01) |
| ***A62B 18/00*** | (2006.01) |
| ***A62B 23/00*** | (2006.01) |
| ***A41D 13/11*** | (2006.01) |
| ***A62B 7/10*** | (2006.01) |
| *A62B 9/04* | (2006.01) |

(52) U.S. Cl.
CPC ..... *A62B 23/025* (2013.01); *A41D 13/11* (2013.01); *A41D 13/1107* (2013.01); *A41D 13/1138* (2013.01); *A41D 13/1161* (2013.01); *A62B 7/10* (2013.01); *A62B 18/00* (2013.01); *A62B 18/02* (2013.01); *A62B 18/025* (2013.01); *A62B 18/084* (2013.01); *A62B 23/00* (2013.01); *A62B 23/02* (2013.01); *A62B 9/04* (2013.01)

(58) Field of Classification Search
CPC .. A61M 16/00; A61M 16/06; A61M 16/0605; A61M 16/0683; A61M 16/0694; A61M 2016/0661; A62B 7/10; A62B 9/04; A62B 18/00; A62B 18/02; A62B 18/08; A62B 18/084; A62B 23/00; A62B 23/02; A62B 23/025; A62B 18/025; A41D 13/11; A41D 13/1107; A41D 13/1138; A41D 13/1161; A41D 13/1184
USPC ..... 128/205.27, 205.29, 206.12, 206.16, 128/206.17, 206.19
See application file for complete search history.

(56) References Cited

U.S. PATENT DOCUMENTS

| | | | | |
|---|---|---|---|---|
| 3,097,642 A | | 7/1963 | Allan | |
| 3,249,108 A | | 5/1966 | Louis | |
| 3,768,100 A | * | 10/1973 | Colman | A41D 13/1161 2/206 |
| 4,951,664 A | * | 8/1990 | Niemeyer | A62B 18/025 128/205.27 |
| 5,131,399 A | * | 7/1992 | Sciarra | A61B 5/1135 128/903 |
| D340,317 S | | 10/1993 | Cole | |
| D413,166 S | | 8/1999 | Snow et al. | |
| 6,394,090 B1 | | 5/2002 | Chen | |

(Continued)

FOREIGN PATENT DOCUMENTS

| | | |
|---|---|---|
| WO | 1991005584 A1 | 5/1991 |
| WO | 2011026515 A1 | 3/2011 |

*Primary Examiner* — Colin W Stuart
(74) *Attorney, Agent, or Firm* — Crawford Maunu PLLC

(57) ABSTRACT

Aspects of various embodiments herein may be implemented as follows. An apparatus has a material shell that conforms to a user's face, and a securing portion connected to the shell that operates to secure a filter to the user's face with the filter covering the user's nose and mouth. A securing force is applied to the filter via the first material portion in a direction toward the user's face, thereby sealing the filter around the user's nose and mouth. Various implementations involve elastic and other material that facilitate sealing of the filter around the user's nose and mouth.

18 Claims, 4 Drawing Sheets

(56) References Cited

U.S. PATENT DOCUMENTS

| | | | | |
|---|---|---|---|---|
| 6,698,427 | B1 * | 3/2004 | Clowers | A61M 16/06 128/200.24 |
| 6,805,124 | B2 | 10/2004 | Japuntich et al. | |
| 6,817,362 | B2 * | 11/2004 | Gelinas | A62B 18/025 128/206.12 |
| 7,044,127 | B1 | 5/2006 | Fernandez Decastro | |
| 7,810,493 | B2 | 10/2010 | Resnick | |
| 7,958,889 | B1 | 6/2011 | Fernandez-Decastro | |
| 8,807,134 | B2 | 8/2014 | Ho et al. | |
| 2005/0061327 | A1 | 3/2005 | Martin et al. | |
| 2007/0044803 | A1 | 3/2007 | Xue et al. | |
| 2008/0034458 | A1 * | 2/2008 | Ku | A41D 1/002 2/9 |
| 2008/0223370 | A1 | 9/2008 | Kim | |
| 2010/0018533 | A1 * | 1/2010 | Biedermann | A41D 13/1192 128/206.19 |
| 2010/0101584 | A1 | 4/2010 | Bledstein et al. | |
| 2012/0090615 | A1 * | 4/2012 | Chen | A62B 18/025 128/206.15 |
| 2012/0247474 | A1 * | 10/2012 | Torbenson | A62B 18/02 128/206.15 |
| 2015/0216241 | A1 * | 8/2015 | Lee | A41D 13/1192 128/863 |

* cited by examiner

MASK APPARATUSES AND APPROACH

FIELD

Aspects of various embodiments are directed to mask apparatuses and related approaches.

BACKGROUND

Masks are useful for a variety of applications, ranging from industrial to medical to recreational applications. For instance, industrial masks are often useful or required for certain applications, and can enhance worker safety. Medical masks can be important for ensuring that medical personnel are protected from exposure. Recreational masks can be useful for filtering dust and other particles.

While useful, many masks are uncomfortable to wear, difficult to fit, and may result in less than desirable protection. For instance, many disposable masks are general in size and shape and are difficult to properly conform to individual faces, such as to accommodate facial hair and other varied facial characteristics, which can result in an improper seal. An improper seal can permit passage of particulates, and can result in fogging of glasses (e. g., via improperly fitting nose pieces). These and other matters have presented challenges to the use and implementation of masks for a variety of applications.

SUMMARY

Various example embodiments are directed to masks, and mask apparatuses involving a mask shell, and their implementation.

In accordance with one or more embodiments, an apparatus includes a first material portion that conforms to a user's face, and a second securing portion that is connected to the first material portion and operates with the first material portion to secure a filter to the user's face with the filter covering the user's nose and mouth. For instance, with the filter positioned between the first material portion and the user's face, the second securing portion applies a securing force to the filter via the first material portion in a direction toward the user's face and thereby sealing the filter around the user's nose and mouth.

Various embodiments are further directed to an apparatus as above that further includes the filter. A variety of additional components are implemented in accordance with one or more embodiments, to facilitate alignment of the filter and securing of the filter to the user's face.

The above discussion/summary is not intended to describe each embodiment or every implementation of the present disclosure. The figures and detailed description that follow also exemplify various embodiments.

DESCRIPTION OF THE FIGURES

Various example embodiments may be more completely understood in consideration of the following detailed description in connection with the accompanying drawings, in which.

Figure 1:
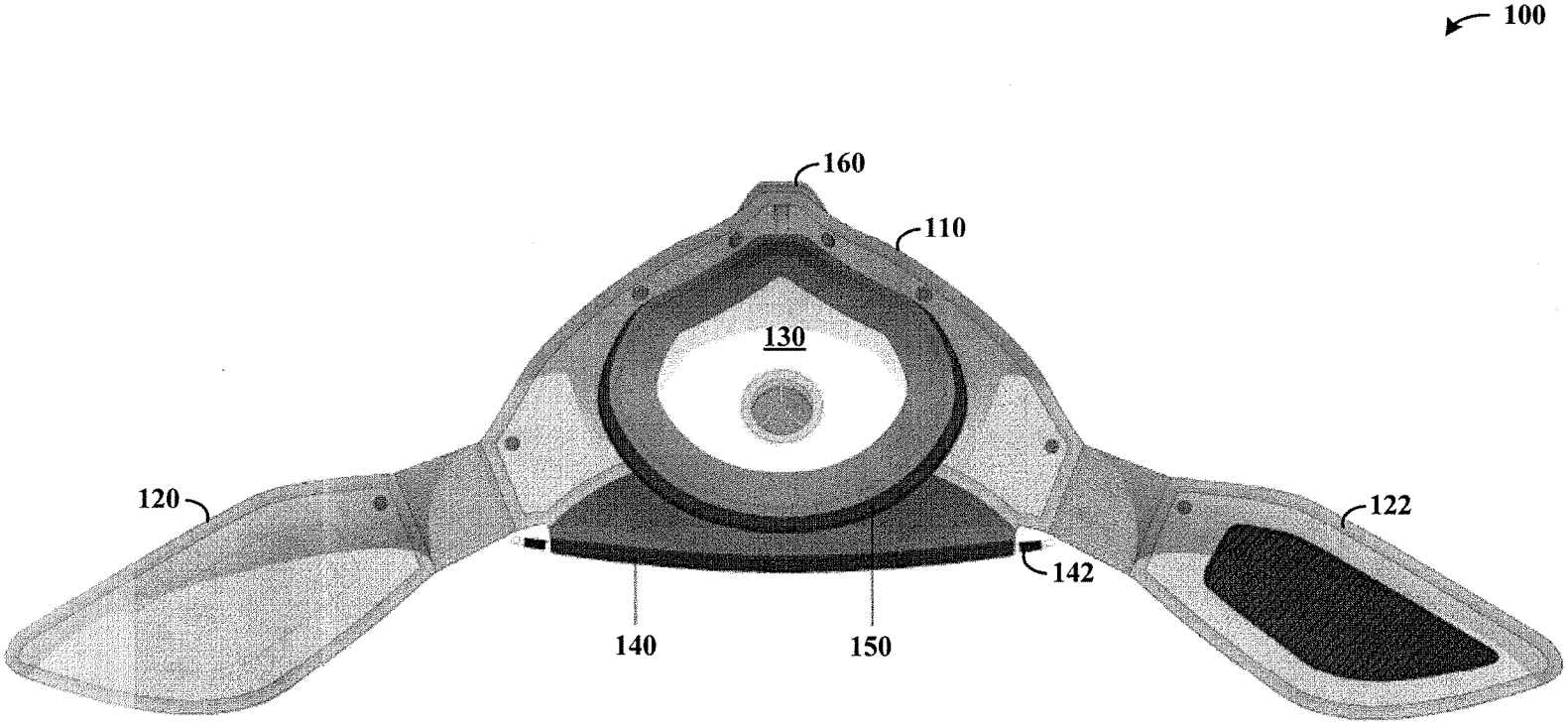
FIG. 1 shows a mask apparatus, as may be implemented in accordance with one or more embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving masks, and particularly involving replaceable masks with a shell-type approach that facilitates fitment of the replaceable mask. In certain implementations, aspects of the present disclosure have been shown to be beneficial when used in the context of disposable masks that can suffer from fitment problems such as those described above, with improved sealing around a user's face and related comfort. While not necessarily so limited, various aspects may be appreciated through a discussion of examples using such exemplary contexts.

According to various example embodiments, aspects of the present disclosure are directed to an apparatus and approach in which a user may place a mask on the inside of a shell. The shell and mask conform to one another and operate to secure the mask against the user's face, with the shell including one or more fasteners that couple to the user and provide a holding force that is translated through the shell to the mask. In some implementations, the shell covers the mask and allows air to pass through to the mask, and in other implementations the shell operates with the mask to secure the mask to a user's face while allowing a portion (e.g., a central portion) of the mask to remain exposed. This approach can assist in accurately conforming masks to a variety of different types of facial features, bone structure and sizes. This approach also facilitates the use of a replacement mask material (e.g., for disposable masks) while providing robust fitment via the reusable shell. Comfort, safety and convenience aspects can all be addressed in this regard, which can be particularly helpful with disposable masks in which low cost can be desirable.

In various embodiments, a flexible material is used to provide a shell (e.g., a frame), that conforms to a replaceable mask. The shell may include, for example, neoprene, mesh material, a moisture-wicking material, cotton material, and/or polyester material. The frame may include multiple openings via which a replaceable mask may be exposed, which can facilitate breathing through the replaceable mask. In some implementations, the shell operates to pass air though a mesh or perforated type structure, to the mask. The shell may have one, two or more straps that secure the shell and, when integrated therewith, a mask to a user. Such straps may include a head strap connected to the shell and/or other straps (e.g., via a hook-and-loop fastener or button). In further embodiments, a holding strap is included for loosely holding the shell around a user's neck while the shell is in an unsecured position (e.g., removed from the user's face).

In some embodiments, fitment and sealing of a shell and corresponding mask is carried out with a conforming component that draws the shell (and therein the mask) with a force against the user's face. In some embodiments, an elastic material extends around a user's nose and mouth and is operable to adjustably apply pressure in this context, providing and adjustable sealing force to the user's face. For instance, an elastic draw string having a rubber compression ring or a round elastic cord can be used to facilitate tensioning. The cord is secured, for example, using a tension ring or other component. In certain embodiments, elastic type material is integrated with the shell such that the elastic type material can be adjusted to accommodate masks of various sizes. Various embodiments employ a conforming component that applies an even, or nearly even, pressure along a path that encloses the user's nose and mouth, providing a seal between the mask and the user's face.

In some embodiments, a mask shell as characterized herein includes a deformable material that holds shape upon physical deformation, within the mask shell. For instance, a bendable aluminum piece of material can be sewn in the shell in an area that covers a user's nose when the shell is in place. The aluminum piece is bendable to conform the mask shell, and therein the mask, to the user's nose.

One or more embodiments employ elastic or other fitting/tightening components at target locations of the shell. In one embodiment, an elastic material is employed near a chin portion of the shell, to facilitate a tight seal around a user's chin. For instance, additional fabric may be applied at a chin region, relative to other portions of the shell, to facilitate the seal. In some embodiments, a strap is integrated with a chin region, for tightening the material at the chin.

In some implementations, an alignment component aligns masks to a shell as characterized herein. Such an alignment component may, for example, include a ridge or other structure that may be part of, or separate from, material that forms other portions of the shell. The alignment component operates to align removable masks relative to the shell, and facilitates proper fitment thereof (e.g., with an inner surface of the mask shell in contact with an outer surface of the filter).

A variety of accessories may be implemented to suit particular embodiments. In some embodiments, ear plugs, safety glasses, a storage pouch, or a light are attached to provide functionality. Certain embodiments employ additional material such as a bandana, dickey or neck scarf that can be useful in windy or cold weather environments. These components may be implemented with a variety of coupling or fastening approaches, such as hook-and-loop or button-type fasteners. A full-head balaclava may be incorporated for certain applications, which may alleviate the need for straps or fasteners.

A variety of masks may be implemented to suit a variety of applications. For instance, dust masks, chemical masks, medical masks and others can be implemented with a shell as discussed herein. These masks may be washable, disposable or usable over an extended period of time. Such masks may include, for example, those available from 3M Company of St. Paul, Minn.; Moldex of Culver City, Calif.; and Honeywell of Morristown, N.J. In addition, a variety of mask sizes can be employed with a common shell. For instance, the shell may be sized with an opening that accommodates various sizes of masks, in which the shell interfaces with each mask to provide a proper seal to the user's face.

In various embodiments, a shell as characterized herein includes a sealing mechanism that mitigates or prevents moisture from reaching a user's glasses or other eyewear. Such approaches may involve nose pieces and/or other conforming components that conform the shell and/or a mask therein to a user's face. This approach can provide a better seal than, for example, a relatively weak strap system as may be employed with disposable masks. Moreover, the mask may be desirably sealed over facial features, facilitating filtration.

Various embodiments are directed to a mask shell having power connectivity for powering accessories. Positive and negative terminals are located on one or more portions of the mask at which accessory attachment is desired, and coupled to a power source. In some implementations, the terminals are coupled to conductors that extend to a remote power source, such as a battery that is located in another portion of the mask. In certain embodiments, a battery is stored in a pouch integrated in a rear portion of the mask shell. The conductors may be implemented with a switch that can be used to power or remove power from an accessory coupled to the terminals. In various embodiments, a cover or covers are included and couple to the terminals, providing a cover when the terminals are unused. Such an approach may be implemented with snap-type terminals, with button covers that couple to the snap-type terminals.

In accordance with one or more embodiments, an apparatus includes a first shell-type portion that conforms to a user's face with a filter placed between the shell and the user. A securing portion, such as a flexible material and straps, is connected to the first shell-type portion and secures the filter to the user's face by applying a force to the shell-type portion (e.g., by securing straps around the back of the user's neck). The filter is thus pressured by the mask to the user's face, covering the user's nose and mouth. Various embodiments further include the filter, which may be essentially freely-moving relative to the shell.

In various implementations, the first shell-type portion applies the securing force along a path of an inner surface of the filter that is in contact with the user's face, with the securing force being about equal along an entire length of the path. This approach is useful, for example, to mitigate issues relating to mask filter placement and securing (e.g., by deforming the filter along a contour that surrounds the user's nose and mouth), to mitigate leaking. An elastic material may be implemented along the path or other interface between the shell-like material and the filter to enhance the fitment and securing. As the securing portion may include robust straps, these straps can aide coupling of the filter to the user (e.g., relative to disposable masks). In certain embodiments, the first shell-type material portion has a central opening in which the filter inserts, and in which a portion of an outer surface of the filter is uncovered and another portion of the outer surface of the filter is covered by the first material portion. An elastic material around the opening may be implemented to conform the filter to the mask and user's face. The second securing portion secures the first material portion against the outer surface of the mask and secures an inner surface of the mask to the user's face.

Certain embodiments employ a securing portion to seal against a bridge of the user's nose, and therein inhibit moisture exhaled from the user from fogging eyewear worn by the user. This approach may be implemented with an inner surface of the nose portion in contact with the user's nose, while the first material portion secures the filter with an inner surface of the filter being in contact with a portion of the user's nose below a portion of the bridge with which the nose portion is in contact.

Various approaches herein involve the use of a replaceable or disposable filter, which can otherwise move independently of a shell or first material as described above. A second securing portion secures an inner surface of the shell with an outer surface of the filter, with an inner surface of the filter being in contact with and secured to the user's face with a securing force applied.

In various implementations, a securing portion as noted herein applies a settable pressure upon a shell for securing a filter to a user's face under respective conditions in which the user has no facial hair and in which the user has facial hair, thereby forming a seal via different amounts of pressure in each of the respective conditions. In certain implementations, the securing portion includes a chin strap configured and arranged to apply the settable pressure. The securing portion thus may, for example, be integrated with the shell, and/or be implemented in separate components coupled to the shell (e.g., a chin strap being separate from straps that extend around a user's neck). Various elastic cords may be similarly implemented to apply a settable force along a path that surrounds the user's nose and mouth, such as with a compression ring that maintains the settable force.

Turning now to the Figures, FIG. 1 shows a mask apparatus 100, as may be implemented in accordance with one or more embodiments. The apparatus 100 includes a shell 110 that incorporates with straps 120 and 122 to secure a mask 130 to a user's head. The shell 110 can be implemented with a variety of materials and shapes, to suit particular embodiments. The straps 120 and 122 operate to secure to one another or another component on a user, applying a force to the mask 130 against the user's face via the shell 110.

The shell 110 can be implemented in a variety of manners. In some implementations, the shell is solid and covers an outer surface of the mask 130 (in the drawing as shown in FIG. 1, an inner surface of the mask is shown with an outer surface facing away). In other implementations, the shell 110 has one or more openings via which the outer surface of mask 130 may be exposed. In either implementation, an inner surface of the shell 110 operates to apply the aforementioned force against the mask 130 when the shell is coupled to a user's face via straps 120. In this context, the mask 130 may be independent from the shell 110 in an unsecured state, and be secured/pressed against a user's face in a secured state. In this context, a removable or disposable mask such as described above can be affixed around a user's nose and mouth to provide air filtration. The shell 110 operates to apply pressure to the mask, such as an even force around the user's nose and mouth that creates a seal.

One or more components shown in FIG. 1 can be implemented separately, or in combination, to suit various embodiments. Further, the apparatus 100 can be implemented with a variety of characteristics, such as those described herein. For instance, in some embodiments a securing foam or other material 140 is employed to enhance fitment to a user, such as to accommodate facial hair while maintaining a seal. A tensioning component 142 may further be employed to tension the material 140. Some embodiments involve material such as foam used at 150 to guide placement of the mask 130 relative to the shell 110. A nosepiece 160 can be implemented to enhance sealing of the shell 110 to the user, mitigating issues such as those relating to moisture escape that can fog eyewear.

Figure 2:
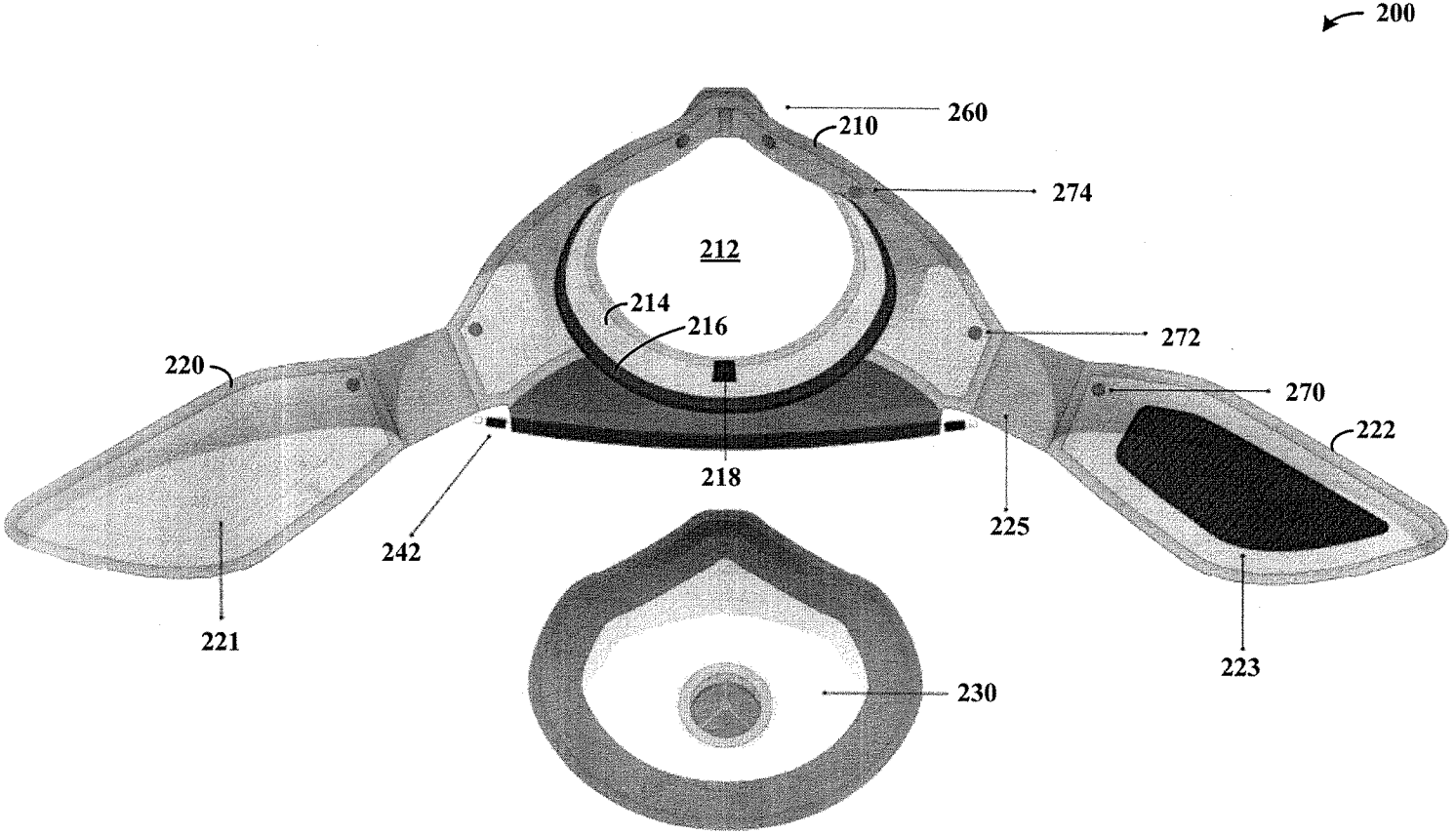
FIG. 2 shows a mask apparatus, as may be implemented in accordance with one or more embodiments.

FIG. 2 shows another mask apparatus 200, as may be implemented in accordance with one or more embodiments. The apparatus 200 may, for example, be implemented in accordance with the apparatus 100 shown in FIG. 1, and in this context various similar reference numerals are used for similar components (e.g., shell 210, straps 220 and 222, mask 230, tensioning component 242, and nose piece 260).

By way of example, the shell 210 is shown with an opening at 212 that accommodates mask 230. An inner surface of the shell 210 at region 214 interfaces with an outer surface of the mask 230 near an edge thereof, and applies a force (with the straps 220 and 222 engaged) that secures the mask against a user's face. Accordingly, region 214 of the shell 210 can be shaped to conform to the mask 230, with a portion of an outer surface of the mask being exposed via opening 212 when held in place. A guide 216, such as a foam guide, operates to align the mask 230 with the shell 210. A fastener 218, such as a hook, may be implemented to help secure the mask 230 to the shell 210 while the mask/shell combination is fitted to a user and secured via the straps 220 and 222.

A variety of additional components are shown in FIG. 2, one or more of which may be implemented with the apparatus 200. For instance, straps 220 and 222 may be secured to one another with hook-and-loop type fasteners 221 and 223 (one including hooks and the other loops), and may employ a stretchable material as shown at 225 to secure the shell to a user. A plurality of connectors can be implemented at various connection points, such as 270, 272 and 274, for connecting accessories such as earplugs, safety glasses and a head strap.

Figure 3:
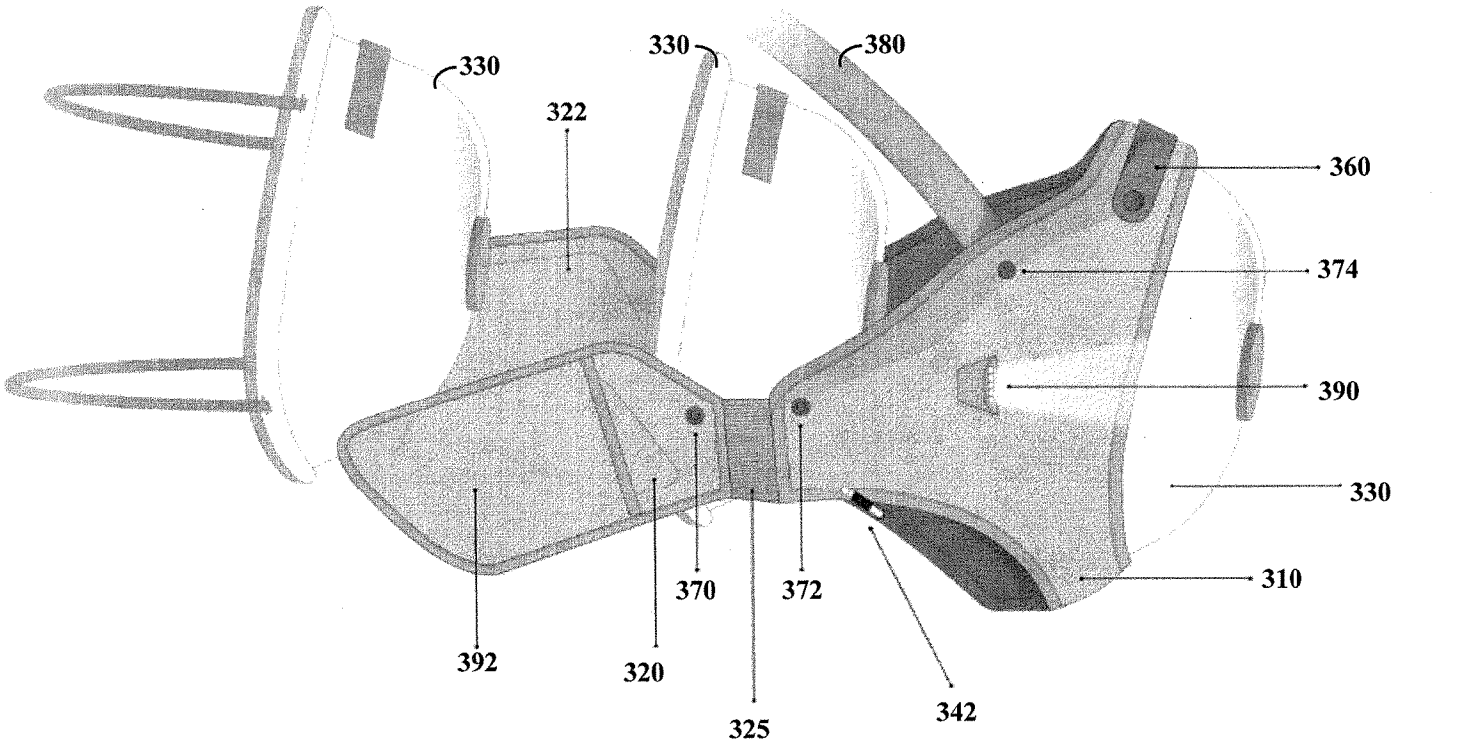
FIG. 3 shows a mask apparatus with insertion of a replaceable mask, in accordance with various embodiments.

FIG. 3 shows a mask apparatus 300 with insertion of a replaceable mask 330, in accordance with various embodiments. The apparatus 300 may be implemented in accordance with the apparatus 100 shown in FIG. 1 and/or with the apparatus 200 shown in FIG. 2. In this context various similar features are not described further in FIG. 3, but are understood as being implementable with the features described in FIGS. 1 and 2. Such features may include shell 310, nosepiece 360, a headstrap rivet 374, tensioning component 342, a stretchable component 325, straps 320 and 322, strap 380 ear plug rivet 370 and safety glasses rivet 372.

The apparatus 300 shows mask 330 at different locations as it is being installed or removed. The apparatus 300 may also be implemented with a light 390, which can be powered via a battery as may be kept in a storage pouch 392.

Figure 4:
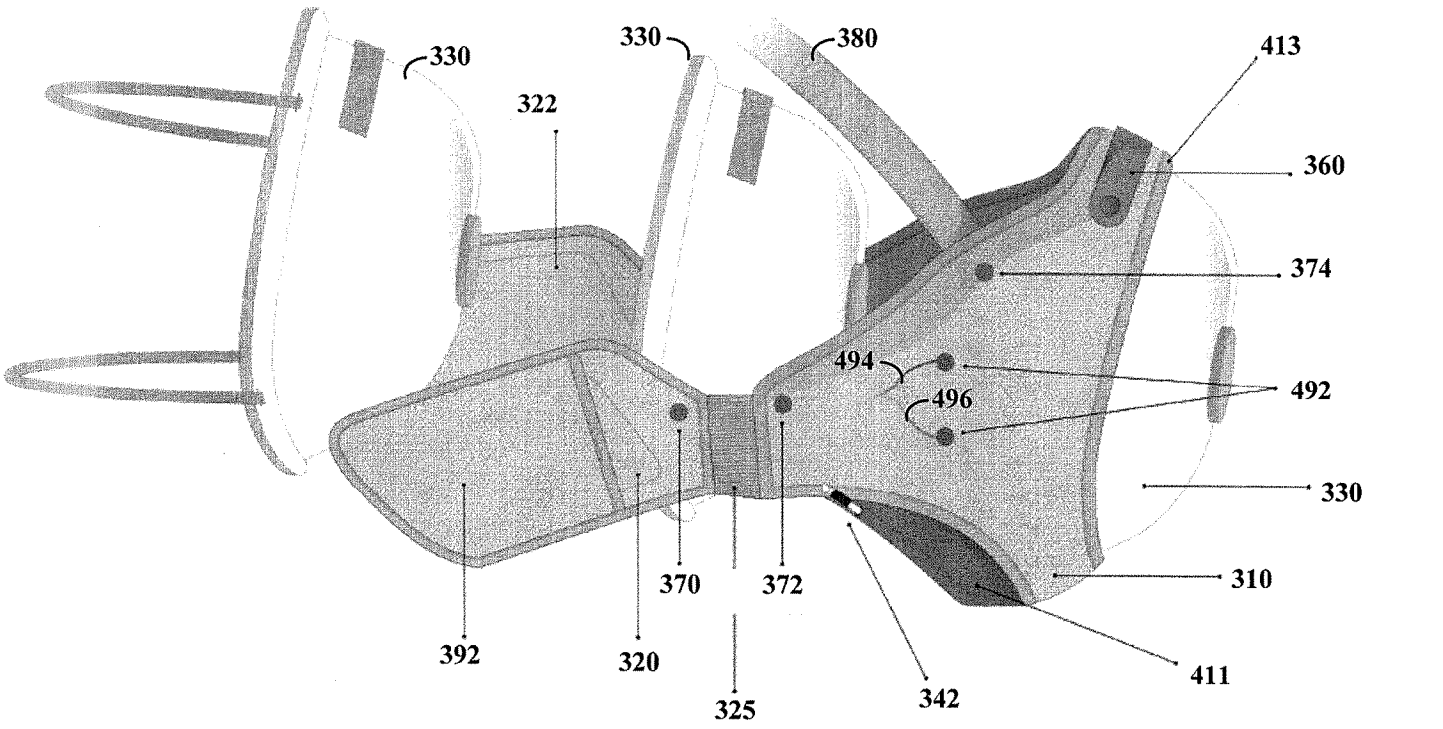
FIG. 4 shows a mask apparatus with insertion of a replaceable mask, in accordance with various embodiments.

FIG. 4 shows a mask apparatus 400 similar to the apparatus 300 shown in FIG. 3, with common reference numerals used to refer to components that may be implemented similarly. FIG. 4 also shows stretchable material 411 (e.g., spandex), an elastic cord 413 (or compression ring) sewn in or otherwise integrated with shell 310, and terminals 492 having wire leads 494 and 496 (shown in a partial cut-away view) coupled to the terminals. These wire leads may, for example, lead back to pouch 392 in which a battery may be placed and coupled (e.g., with an additional battery connector therein and/or with a battery integrated within the mask).

Based upon the above discussion and illustrations, those skilled in the art will readily recognize that various modifications and changes may be made to the various embodiments without strictly following the exemplary embodiments and applications illustrated and described herein. For example, various types of materials can be used, in addition to and/or in alternative to those listed. Strap placement may vary to accommodate different anatomies. In addition, the various embodiments described herein may be combined in certain embodiments, and various aspects of individual embodiments may be implemented as separate embodiments. The embodiments shown in the figures and/or as described herein may be implemented together, or certain components characterized with particular embodiments may be used separately. Such modifications do not depart from the true spirit and scope of various aspects of the invention, including aspects set forth in the claims.

What is claimed is:

1. An apparatus comprising:

a filter configured and arranged to filter air and having a conforming flared shape along an outer periphery thereof that is configured to conform to a user's face; and a mask shell including a first material portion configured and arranged to conform to the flared shape of the filter and to the user's face and therein position the filter to cover the user's nose and mouth, and to pass air for breathing to the filter, the first material portion having an inner periphery defining a central opening that, when engaged with the filter, has an inner surface that extends along the outer periphery of the filter on the flared shape with a central portion of an outer surface of the filter being exposed via the central opening, the inner periphery having an elastic cord encircling the central opening and configured and arranged to apply an elastic force against the filter when the mask shell is secured to the user's face, and a second securing portion connected to the first material portion and configured and arranged with the first material portion and the filter to, with at least a portion of the filter positioned between the first material portion and the user's face, secure the filter to the user's face with the filter covering the user's nose and mouth, by applying a securing force to the filter via the first material portion in a direction toward the user's face and thereby sealing the filter around the user's nose and mouth along an entire length of a path of an inner surface of the flared shape that is in contact with the user's face, when in use, the elastic force being applied through the securing force provided by the second securing portion.

2. The apparatus of claim 1, wherein the first material portion is configured and arranged with the second securing portion to conform the filter to the user's face by deforming the filter along a contour that surrounds the user's nose and mouth to form the flared shape and to hold the filter in the flared shape when secured to the user's face.

3. The apparatus of claim 1, wherein the second securing portion and the first material portion are configured and arranged to apply distributed pressure along a path on the user's face that extends around the user's nose and mouth, thereby securing the filter along the path and mitigating leakage, with a central portion of the filter having an inner surface that is offset from a surface of the user's face covered by the central portion of the filter, when in use.

4. The apparatus of claim 3, wherein the elastic cord is adapted to extend along the path on the user's face and configured and arranged to facilitate application of the distributed pressure.

5. The apparatus of claim 1, wherein the first material portion and the filter have a common shape, with the first material portion being configured and arranged to conform to an outer surface of the filter while an inner surface of the filter conforms to the user's face.

6. The apparatus of claim 1, wherein the mask shell includes a nose portion configured and arranged to seal against a bridge of the user's nose, and therein inhibit moisture exhaled from the user from fogging eyewear worn by the user.

7. The apparatus of claim 6, wherein the nose portion is configured and arranged to seal directly against the bridge of the user's nose with an inner surface of the nose portion in contact with the user's nose, while the first material portion secures the filter with an inner surface of the filter being in contact with a portion of the user's nose below a portion of the bridge with which the nose portion is in contact, when in use.

8. The apparatus of claim 1, wherein the filter and mask shell are configured and arranged to move independently of one another in an unsecured state, and the second securing portion is configured and arranged to secure an inner surface of the first material portion with an outer surface of the filter, with an inner surface of the filter configured to contact and secure to the user's face when in use, in a secured state in which the securing force secures the filter relative to the mask shell.

9. The apparatus of claim 1, wherein the second securing portion is configured and arranged to apply a settable pressure upon the first material portion for securing the filter to the user's face under respective conditions in which the user has no facial hair and in which the user has facial hair, thereby forming a seal via different amounts of pressure in each of the respective conditions.

10. The apparatus of claim 9, wherein the second securing portion includes a chin strap configured and arranged to apply the settable pressure.

11. The apparatus of claim 1, wherein the elastic cord is coupled to the first material portion and configured and arranged to directly contact and align the filter to the first material portion, facilitating replacement and alignment of the filter.

12. The apparatus of claim 1, wherein the elastic cord is configured and arranged to apply the securing force as a settable force along a path that surrounds the user's nose and mouth, and a compression ring that maintains the settable force.

13. The apparatus of claim 1, further including electrical terminals and electrical leads coupled to the electrical terminals, the electrical leads being configured and arranged with the electrical terminals to couple power from a power source via the electrical terminals.

14. The apparatus of claim 13, wherein the electrical terminals include snap fasteners configured and arranged to couple to corresponding snap fasteners, and wherein the electrical leads have a connector configured and arranged to connect to a battery housed in the mask shell and to provide the power from the battery.

15. An apparatus comprising:

a filter configured and arranged to filter air and having a conforming flared shape along an outer periphery thereof that is configured to conform to a user's face; and a mask shell including a first material portion configured and arranged to conform to the flared shape of the filter and to the user's face and therein position the filter to cover the user's nose and mouth, and to pass air for breathing to the filter, the first material portion having an inner periphery defining a central opening that, when engaged with the filter, extends along the outer periphery of the filter on the flared shape, an alignment portion configured and arranged to align the filter to the mask shell, with an inner surface of the mask shell in contact with an outer surface of the filter, the alignment portion including an elastic cord coupled to the first material portion and configured and arranged to directly contact and align the filter to the first material portion, facilitating replacement and alignment of the filter; and a second securing portion connected to the first material portion and configured and arranged with the first material portion and the filter to, with at least a portion of the filter positioned between the first material portion and the user's face, secure the filter to the user's face with the filter covering the user's nose and mouth, by applying a securing force to the filter via the first material portion in a direction toward the user's face and thereby sealing the filter around the user's nose and mouth with the securing force being equal along an entire length of a path of an inner surface of the flared shape that is in contact with the user's face, when in use.

16. An apparatus comprising:

a filter having a conforming flared shape along an outer periphery thereof that is configured to conform to a user's face when in use, a first material portion having a periphery that defines a central opening therein with an elastic cord encircling the central opening, the first material portion being configured and arranged to, when in use with the filter, conform to the user's face, interface with an outer surface of the outer periphery of the filter to expose a central portion of an outer surface of the filter via the central opening with an inner surface of the first material extending along a peripheral portion of the filter, and a second securing portion connected to the first material portion and configured and arranged with the first material portion to, with the filter positioned between the first material portion and the user's face in use, secure the filter to the user's face with the filter covering the user's nose and mouth, by applying an even elastic securing force to the flared shape of the filter via the elastic cord at the periphery of the first material portion in a direction toward the user's face and thereby sealing the periphery of the filter around the user's nose and mouth.

17. The apparatus of claim 16, wherein the first material portion is configured and arranged with the second securing portion to apply a securing force along a path of an inner surface of the filter that is configured to contact the user's face when in use, securing force being equal along an entire length of the path.

18. The apparatus of claim 16, wherein a portion of the outer surface of the filter is covered by the first material portion, with the second securing portion configured for securing the first material portion against the outer surface of the filter and securing an inner surface of the filter to the user's face, when in use.

* * * * *